United States Patent [19]

Notbohm

[11] 3,972,771

[45] Aug. 3, 1976

[54] HEADBOX WITH VARIABLE EDDY DECAY LENGTH

[75] Inventor: Willard C. Notbohm, Watertown, N.Y.

[73] Assignee: The Black Clawson Company, Middletown, Ohio

[22] Filed: Feb. 28, 1974

[21] Appl. No.: 446,660

[52] U.S. Cl. ..... 162/343; 162/346; 162/347

[51] Int. Cl.[2] ..... D21F 1/06

[58] Field of Search ..... 162/343, 346, 347, 336, 162/303, 203, 212, 216, 342, 344

[56] References Cited

UNITED STATES PATENTS

| | | | |
|---|---|---|---|
| 3,328,237 | 6/1967 | Notbohm | 162/343 |
| 3,578,558 | 5/1971 | McCarrick et al. | 162/303 |
| 3,578,560 | 5/1971 | Notbohm et al. | 162/344 |
| 3,661,706 | 5/1972 | De Noyer | 162/343 |
| 3,730,831 | 5/1973 | Stevens | 162/343 X |
| 3,734,822 | 5/1973 | Bennett et al. | 162/343 |
| 3,837,999 | 9/1974 | Chung | 162/203 X |
| 3,843,470 | 10/1974 | Betley et al. | 162/343 |
| 3,853,695 | 12/1974 | Back et al. | 162/216 |

*Primary Examiner*—S. Leon Bashore
*Assistant Examiner*—Richard V. Fisher
*Attorney, Agent, or Firm*—Biebel, French & Nauman

[57] ABSTRACT

A paper machine headbox in which the ideal distance or eddy decay length may be varied to provide improved formation and tensile ratio for different grades and types of paper. The slice for the headbox is defined by a pivotally mounted nozzle blade and an apron blade, and one of the blades is mounted for sliding movement toward and away from the other. With this construction, the effective flow area through the flow channel to the slice may be varied, thereby varying the velocity of the paper making stock delivered to the slice and the ideal distance or eddy decay length.

6 Claims, 2 Drawing Figures

HEADBOX WITH VARIABLE EDDY DECAY LENGTH

BACKGROUND OF THE INVENTION

A number of process variables are associated with the operation of a paper making machine headbox, the control of which directly affect the quality of paper produced. For example, at the wet end the slice jet velocity and total head will greatly affect such things as formation and tensile ratio as well as interply bonding.

A significant factor in controlling these properties is believed to be the ideal distance (I.D.) or eddy decay length. In a so called "bunched tube headbox" in which the stock supply chamber communicates with the slice through a plurality of rows of tubes, the ideal distance or eddy decay length, for the eddies created by the changes in velocity as the stock is discharged from the multiple tubes into the slice chamber immediately preceding the slice outlet, may be calculated by the following formula based on a formula by Jasper Mardon:

$$\text{I.D.} = K \times V_{AV} \times (d_H)^{1/2} / (d_R)^{1/3}$$

wherein $K$ is a coefficient, $V_{AV}$ is the average velocity through the flow channel interconnecting the stock supply chamber and the slice at 100% open area in feet per second, $d_H$ is the inside diameter of the tubes in the flow channel in inches, and $d_R$ is the depth of the flow passage in a direction normal to the cross machine direction and the length of the tubes.

From the above it will be seen that the ideal distance is directly proportional to $V_{AV}$ and $d_H$ and inversely proportional to $d_R$. Thus, the ideal distance or eddy decay length can be increased by increasing the velocity through the flow channel or increasing the diameter of the tubes or by decreasing the effective depth of the flow channel. However, with the head of the stock delivered to the slice being fixed by other considerations and the length and diameter of the tubes in the flow channel also fixed, it would appear that, as a practical matter, the ideal distance or eddy decay length would be a fixed character of a particular headbox. This is the case in almost all current designs.

SUMMARY OF THE INVENTION

The present invention provides means for varying the ideal distance or eddy decay length of a headbox to provide improved quality paper for particular grades and weights thereof, and to correct for an incorrect estimate of operating flow volume made when originally sizing a headbox flow system. The present invention is particularly adapted for use with a headbox of the bunched tube type which includes a flow channel defined by a plurality of rows of tubes extending from the stock supply chamber to the slice chamber between the discharge ends of the tubes and thereby creating a corresponding plurality of eddies as the stock enters the slice chamber.

In a preferred embodiment of the invention the slice of the headbox is defined by a pair of opposed slice blades, one of which is a pivotally mounted nozzle blade, and one of the blades is then attached to the headbox in a manner which permits sliding movement thereof in a direction normal to the flow through the flow channel.

Thus, depth of the flow channel may be varied by sliding one of the blades across the outlet ends of the rows of tubes from the flow channel, thereby varying $V_{AV}$ and $d_R$ to obtain the optimum I.D. for a particular grade and weight of paper and machine speed to provide improved formation and tensile ratio.

After the slidable blade is positioned as desired with respect to the outlet end of the tubes, the inclination of the pivotally mounted nozzle blade may then be adjusted to establish the desired slice opening. With the ideal distance determined by adjustment of the slidable blade with respect to the outlets of the tubes, the inlet ends of the tubes blocked by the slidable blade can then be plugged semipermanently, with, for example, rubber stoppers. Thereafter if the grades, speeds, etc., should be changed, the tubes can be unplugged and the slidable blade readjusted to original position.

DESCRIPTION OF THE PREFERRED EMBODIMENTS

Figure 1:
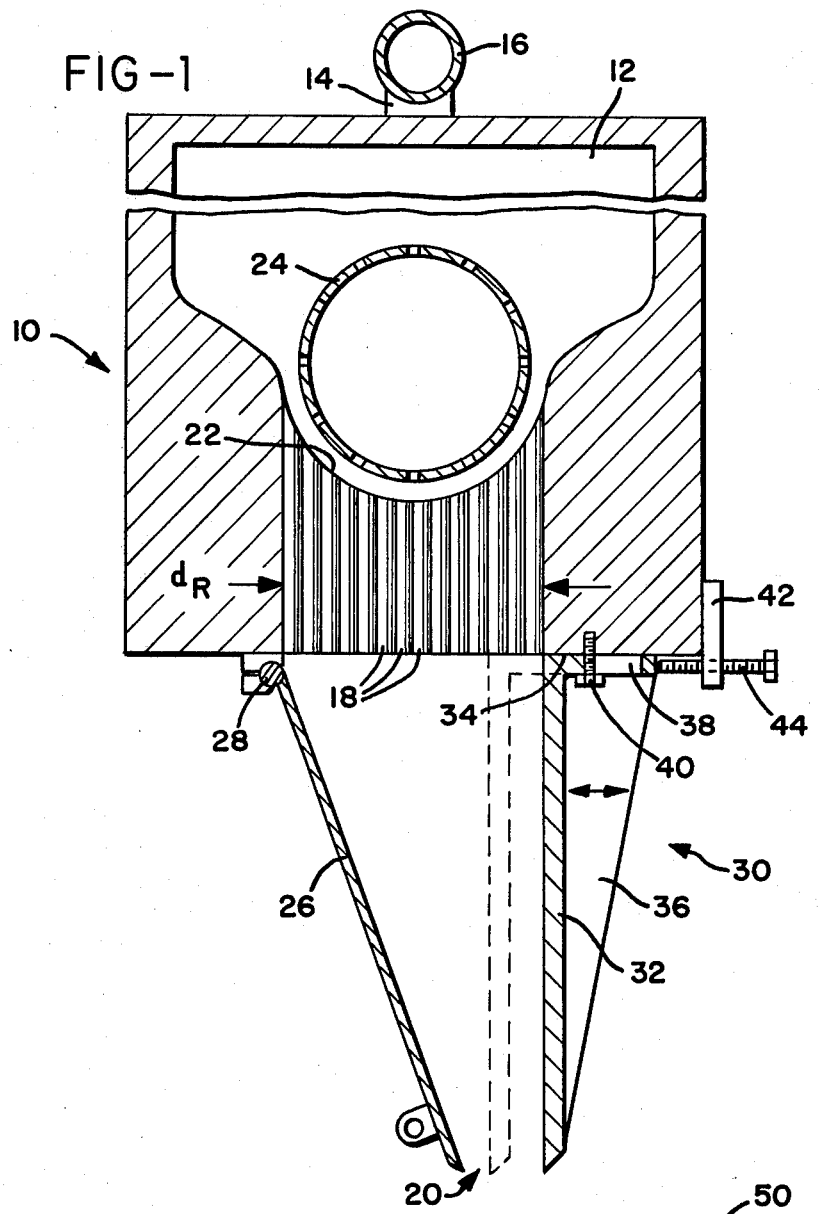
FIG. 1 is a view of a headbox, with parts in section, incorporating the present invention.

Turning initially to FIG. 1 of the drawings, a headbox 10 is shown which is particularly adapted to deposit stock in a vertically oriented forming zone of a double wire paper making machine. The headbox 10 includes a stock supply chamber 12 fed by a plurality of feed pipes, one of which is shown at 14, which in turn are fed from a cross manifold 16 communicating with a supply of paper making stock.

A flow channel from the stock supply chamber 12 is defined by a plurality of rows of tubes 18 providing a corresponding plurality of passages which empty at their downstream ends into the slice chamber within a slice assembly 20. The upstream ends of the tubes 18 are preferably curved, as indicated at 22, and an apertured rectifier roll 24 can be mounted for rotation in closely spaced relationship to the upstream ends of the tubes 18. Of course, the danger of tube plugging decreases with increases in tube diameter, so that in a particular installation the diameters of the tubes may be great enough that a rectifier roll is unnecessary.

The slice assembly 20 comprises a nozzle blade 26 pivotally mounted, as at 28, and an apron blade 30 extending in opposing relationship to the nozzle blade 26 to define therewith the slice chamber which extends from the downstream ends of the tubes 18 to the slice outlet between the downstream ends of the blades 26 and 30. The apron blade 30 includes a downwardly extending leg 32 and a horizontally extending leg 34 joined to the leg 32 and reenforced by gusset means, as at 36. Leg 34 is slotted, as indicated at 38, and a bolt or the like 40 is received through the slot 38 and threaded into a portion of the supporting structure of the headbox. Thus the flow area of the channel defined by the tubes 18 has a first pair of opposed boundaries defined by the upper ends of the blades 26 and 30 which extend in the cross-machine direction and are therefore relatively long and a second pair of boundaries which are determined by the spacing between the upper ends of the blades 26 and 30 and are therefore relatively short.

A bracket 42 extends down one side of the headbox and threadably receives a jack screw 44 which bears at its inner end against the leg 34. With this construction it will be seen that the depth ($d_R$) of the flow channel may be adjusted to obtain the optimum ideal distance (I.D.) by loosening the bolt 40 and turning the jack screw 44 in the bracket 42.

This will cause the apron blade to shift, to the left as seen in FIG. 1, decreasing the effective flow area of the flow channel along a line extending in the cross machine direction of the paper making machine with which the headbox 10 is associated. In other words, such movement of the apron blade 30 will change the effective distance between the pair of relatively long boundaries of the flow channel and thus corresondingly change its depth.

After the optimum ideal distance or eddy decay length has been determined by adjusting the apron blade 30, the bolt 40 can be tightened to fix the apron blade in the desired position blocking one or more rows of the tubes 18. Assuming that the condition thus established is to remain stable for a relatively long period of time, the upstream ends of the tubes can be semipermanently blocked with, for example, rubber stoppers.

Thereafter, when paper machine speed or the type or weight of paper to be produced changes, the tubes can be unplugged and the apron blade 30 is adjusted for the optimum ideal distance or eddy decay length for the new grade, weight or machine speed.

In the above description the invention is described is conjunction with a headbox particularly adapted for use in a paper making machine having a vertically disposed forming zone. It will be apparent, however, that the present invention is also adapted to use in paper making machines having the forming zones thereof disposed other than vertically.

Figure 2:
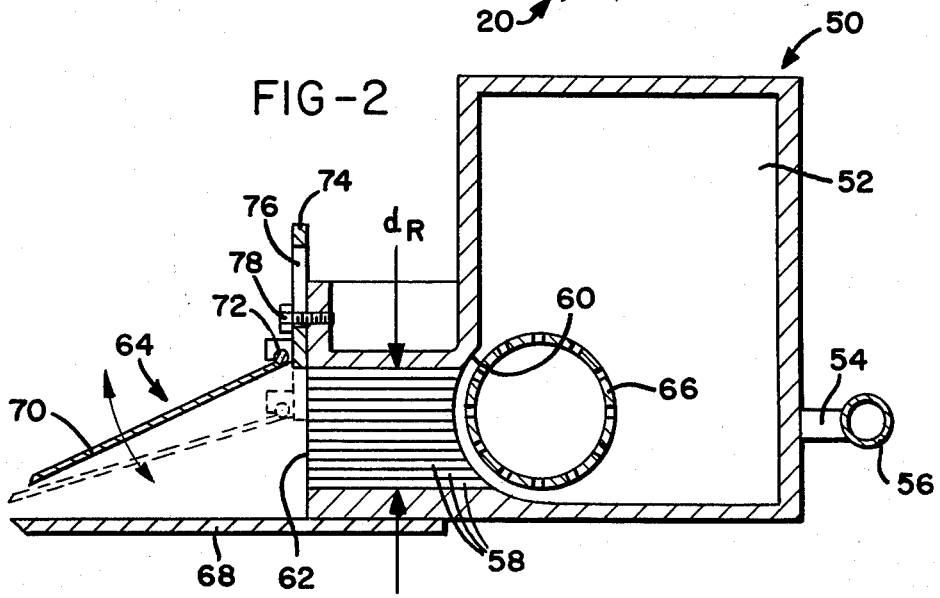
FIG. 2 is a cross sectional view of a second preferred embodiment of the invention.

For example, and as seen in FIG. 2, a headbox 50 incorporating the present invention may be utilized with a fourdrinier type paper making machine. Thus, headbox 50 includes a stock supply chamber 52 fed by a plurality of pipes 54 which are in turn fed by a supply manifold 56 communicating with a source of paper making stock.

The flow channel from the headbox 50 is defined by a plurality of horizontally disposed rows of tubes 58 having their curved, upstream ends 60 communicating with the stock supply chamber 52 and their downstream ends 62 communicating with the slice assembly 64. Preferably an apertured rectifier roll 66 will be positioned in closely spaced relationship to the upstream ends 60 of the tubes 58.

The slice assembly 64 is defined by an apron blade 68 extending substantially parallel to the tubes 58 and a nozzle blade 70 mounted for pivotal movement at 72. The pivotal mounting for the nozzle blade includes an upstanding plate 74 slotted, as at 76, and receiving a bolt 78 which is threaded into an upstanding portion of the headbox 50.

With this construction it will be seen that the nozzle blade 70 may be moved vertically adjacent the downstream ends of the tubes 58 by loosening the bolt 78 and sliding the plate 74 downwardly across the outlet ends of the tubes 58, thereby decreasing the effective flow area of the flow channel defined by the tubes 58 progressively along a line extending parallel to the cross machine direction of the paper making machine with which the headbox 50 is associated.

This has the effect of decreasing the depth ($d_R$) of the flow channel and thereby varying the ideal distance or eddy decay length while maintaining the pressure of the stock supply substantially constant. As in the embodiment described above, after the nozzle blade 70 has been adjusted for optimum conditions, the upstream ends 60 of the tubes 58 can be plugged semipermanently with, for example, rubber stoppers.

This prevents stock from stagnating in the covered tubes but yet permits the tubes to be reopened when changing process conditions require a readjustment of the nozzle blade to reestablish the ideal distance or eddy decay length for the new grade or weight of paper or new machine speed.

From the above it will be seen that the present invention provides a system for obtaining the optimum ideal distance or eddy decay length for a paper machine headbox without varying the headbox pressure, dilution or slice opening to suit paper making requirements to thereby provide improved paper formation and sheet test.

While the forms of apparatus herein described constitute preferred embodiments of the invention, it is to be understood that the invention is not limited to these precise forms of apparatus, and that changes may be made therein without departing from the scope of the invention.

I claim:

1. In a headbox comprising opposed slice blades defining a slice chamber having at the downstream end thereof a slice opening of variable area for feeding paper making stock to a forming member, paper making stock supplying means, a flow channel having an upstream end receiving paper making stock from said paper making stock supply means and a downstream end discharging said paper making stock into said slice chamber, said flow channel having a flow area defined by first, relatively long, opposed boundaries extending in the cross machine direction of said headbox and constituting the width of said flow channel and second, relatively short, opposed boundaries extending between said first opposed boundaries and defining the depth of said flow channel, and means subdividing said flow channel into a plurality of passages to create a corresponding plurality of eddies as the stock passes from said passages into said slice chamber, the improvement comprising means for selectively varying the velocity of flow through said flow channel and the decay length of said eddies, comprising:

means movable across said flow area of said flow channel for changing the effective distance between said first boundaries and the depth of said flow channel by blocking or uncovering portions of said flow channel progressively along a line parallel to said first boundaries.

2. The headbox of claim 1 wherein said movable means is associated with one of said blades and movable therewith.

3. The headbox of claim 1 wherein said subdividing means comprises a plurality of tubular members arranged in a plurality of rows extending in said cross machine direction, and said movable means comprises means for closing or opening simultaneously all said passages in rows thereof.

4. The headbox of claim 1 wherein said slice blades include a nozzle blade, and said nozzle blade is pivotally mounted on said movable means for pivotal movement of said nozzle blade independently of movement of said movable means.

5. The headbox of claim 1 wherein said slice blades include a pivotally mounted nozzle blade and an apron blade, and said apron blade is fixed with respect to said movable means.

6. A headbox comprising:

a. a stock supply chamber for supplying stock at a predetermined head, b. a plurality of tubular means defining a flow channel composed of a corresponding plurality of passages communicating with said stock supply chamber at the upstream end thereof, c. said tubular means being arranged in a plurality of rows with said rows extending in the cross machine direction of said headbox, d. a nozzle blade pivotally mounted along one edge thereof adjacent the downstream end of an outermost one of said rows of tubular means, e. an apron blade extending in opposed relationship to said nozzle blade adjacent the downstream end of the other of said outermost rows of tubular means and cooperating with said nozzle blade to define a slice chamber leading to a discharge slot between the downstream ends of said blades, and f. means for controlling the decay length of the eddies created by discharge of stock from said plurality of passages into the upstream end of said slice chamber, further comprising, i. mounting means associated with said nozzle and apron blades extending substantially perpendicularly with respect to said flow channel, ii. means defining a slotted opening formed in said mounting means for one of said blades, and iii. fastening means extending through said slotted opening to provide for sliding movement of said slotted mounting means across the downstream end of said flow channel for progressively covering the downstream ends of said rows of passages and thereby increasing the velocity through the remaining uncovered passages and the decay length of said eddies.

* * * * *